United States Patent [19]

Liaaen

[11] 4,077,352

[45] Mar. 7, 1978

[54] VESSEL PROPULSION AND/OR STEERING MEANS

[75] Inventor: Anders Marius Liaaen, Alesund, Norway

[73] Assignee: A. M. Liaaen A/S, Alesund, Norway

[21] Appl. No.: 760,466

[22] Filed: Jan. 18, 1977

[30] Foreign Application Priority Data

Jan. 23, 1976 Norway ..... 760221

[51] Int. Cl.[2] ..... B63H 1/14

[52] U.S. Cl. ..... 115/35; 115/34 R; 115/41 R

[58] Field of Search ..... 115/41 R, 41 HT, 35, 115/34 R; 114/147, 151

[56] References Cited

FOREIGN PATENT DOCUMENTS

| | | | |
|---|---|---|---|
| 2,229,608 | 12/1974 | France | 115/41 R |
| 793,410 | 4/1958 | United Kingdom | 115/41 R |

*Primary Examiner*—Trygve M. Blix
*Assistant Examiner*—Sherman D. Basinger
*Attorney, Agent, or Firm*—Watson, Cole, Grindle & Watson

[57] ABSTRACT

A vessel propeller propulsion and/or steering device of the type comprising a propeller assembly mounted about a vertical axis relatively to the vessel, and structure for transfer of drive power to the propeller and rotational power to the propeller assembly from the inside of the vessel, and with structure for mounting and dismounting the propeller assembly in a submerged condition relatively to a downwardly open cavity in the vessel, the propeller assembly comprising a column adapted to be connected to the vessel and containing a hollow steering trunk for transfer of rotational power to the assembly, pivotably and axially movably supported in an intermediate sleeve in the column, a servomotor being provided between the trunk and the column of the propeller assembly for the purpose of effecting controlled axial relative movements of the trunk and the sleeve when mounting or dismounting the propeller assembly.

7 Claims, 5 Drawing Figures

VESSEL PROPULSION AND/OR STEERING MEANS

BACKGROUND OF THE INVENTION

1. Field of the Invention

The present invention relates to an under-water propulsion and/or steering device for a vessel which can be mounted underneath a submerged part of a vessel. Such a device includes a propeller (such as a a controllable pitch propeller), an assembly which mounts the propeller and which is rotatably connected to the vessel, and a means for mounting and dismounting the propeller assembly in a submerged condition.

The term vessel is intended to include any type of a floating structure on which the invention might be used, such as pontoons; floating members for carrying equipment for offshore activities, i.e., such as members where it is of importance to keep the vessel in a given position; and floating members where it must be possible to perform repair and maintenance work on the propulsion and/or steering device assembly without docking the vessel.

2. Description of Prior Art

Several means have been proposed for mounting and dismounting a propulsion and/or steering device on a vessel in submerged condition. A major difficulty has been to maintain an effective sealing of the propeller assembly and the inside of the vessel during mounting and dismounting of the assembly. To maintain continuous sealing of both the vessel and the propeller assembly, it has previously i.a. been proposed to make the means for transfer of rotational power to the assembly as a hollow trunk which surrounds the means for transfer of drive power to the propeller, these means being rotatably mounted in a sleeve which is to carry the assembly on the vessel. In these proposed systems the necessary sealing means is positioned at the end of an intermediate sleeve provided between the trunk of the propulsion and/or steering device and the sleeve, the trunk being adapted to be moved axially relatively to the intermediate sleeve so as to obtain the desired sealing during all the steps of the mounting and dismounting of the propeller assembly.

The relative axial movement of the trunk and the intermediate sleeve have been effected by means of manually-controlled exterior jacks serving to cause vertical movement of the assembly. However, these jack systems tend to be complicated and require manual work which, at least partly, has to be done by divers.

SUMMARY OF THE INVENTION

According to the present invention it is possible to impart the axial movements to the propulsion and/or steering device by the use of means inside the vessel, at a time when the trunk and the intermediate sleeve are arranged coaxially with a radial interspace forming a chamber. According to the invention this chamber serves as at least one servomotor chamber adapted to cause the desired relative axial movements of the trunk and the intermediate sleeve to achieve the desired sealing during mounting and dismounting.

The utilization of the interspace chamber as a servomotor may suitably be achieved by locating gaskets in appropriate positions along the length of the chamber, whereby the individual chamber portions may be so pressurized by a fluid from controlled sources inside (or outside) the vessel as to cause the desired relative axial movements.

In order to hereby to economize the necessary quantity of pressure fluid, at least one chamber may be arranged in the propeller assembly, or preferably, in its column, which chamber or chambers are connected to the interspace chambers in such a way as to serve as fluid accumulator.

DESCRIPTION OF THE DRAWINGS

The device according to the invention will now be described with reference to the accompanying drawings which show a preferred embodiment.

In the Drawings

DESCRIPTION OF THE PREFERRED EMBODIMENTS

Figure 1:
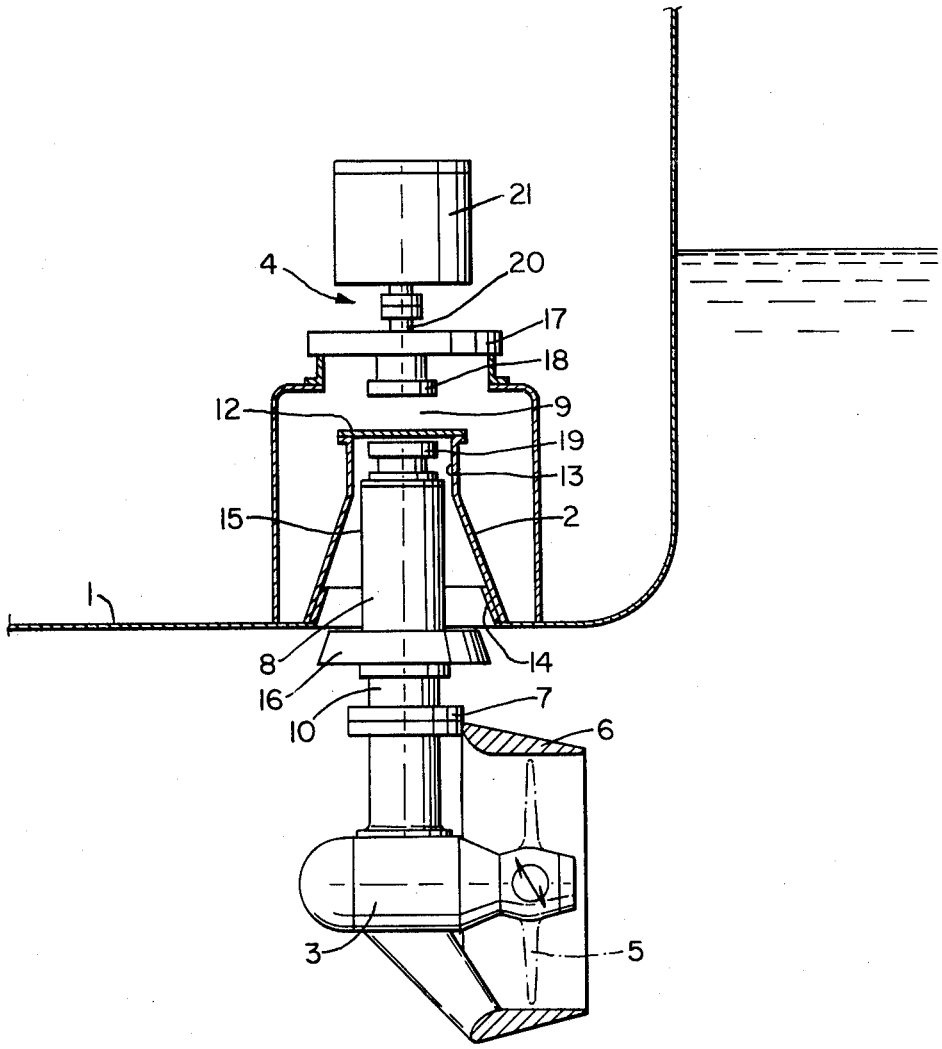
FIGS. 1 and 2 show the complete propeller assembly in two stages of a mounting or dismounting operation.
Figure 2:
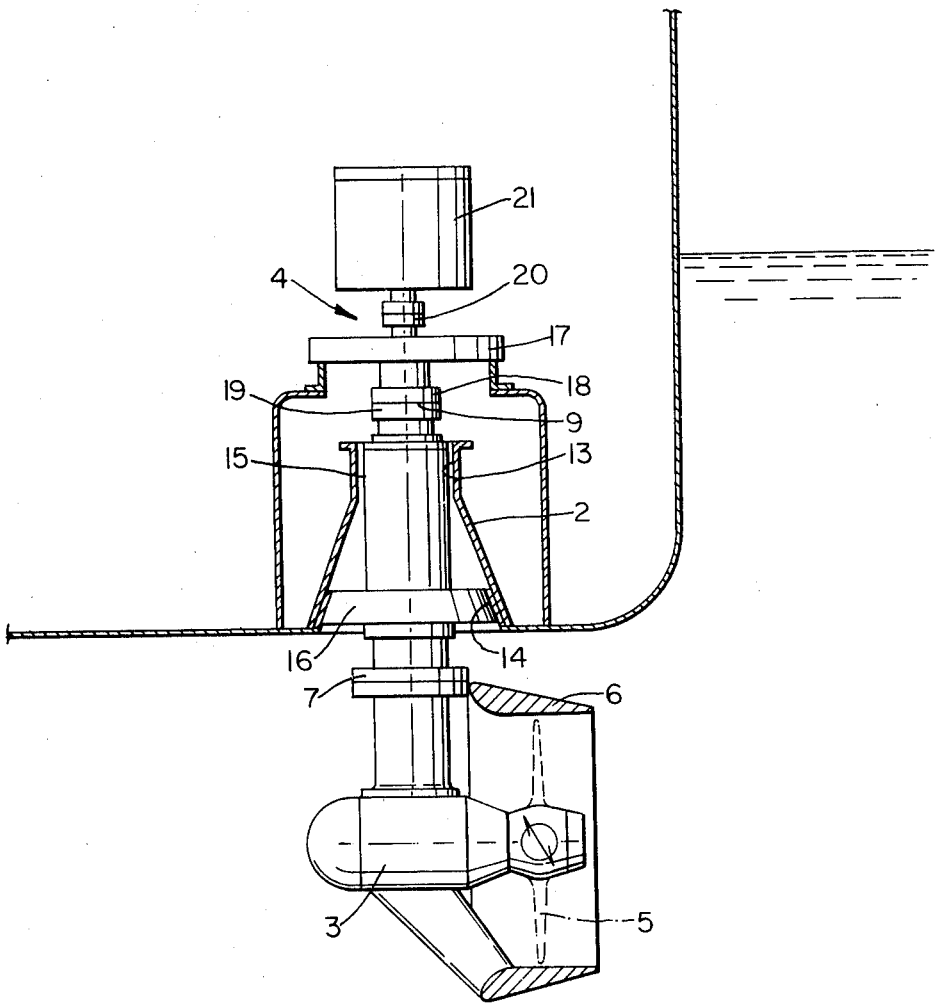

In FIGS. 1 and 2, the hull 1 of a vessel includes a downwardly open sleeve 2 in the bottom which is adapted to receive the various parts which serve to connect a propeller assembly 3 and the structure inside the vessel for the supply of rotation power to the assembly itself and also the drive power to the propeller.

The propeller assembly 3 is shown equipped with a controllable pitch propeller 5, but it will be appreciated that the propeller may also be of a constant pitch type. The propeller 5 is shown positioned in a nozzle 6 which, however, is not absolutely required. The propeller assembly 3 is connected to a column 8 through a flange connection 7, and the top end of the column 8 is adapted to be connected to the structure inside the vessel through a flange connection 19. The column 8 contains the drive shaft for the propeller 5 and a cylindrical trunk 10 for transfer of rotational movement to the propeller assembly 3 about the axis of the trunk.

The top of the sleeve 2 may be closed by means of a cover 12, and the sleeve 2 has sealing and centering surfaces 13,14 adapted to cooperate with surfaces 15,16 on the column 8.

A steering unit 17 for transfer of rotation power through a flange connection 18,19 to the trunk 10 is positioned above the sleeve 2, and the drive shaft from a drive power engine 21 is connected to a drive shaft extending through an axial bore in the trunk 10.

In FIG. 1 the propeller assembly is shown while being moved into or out of the sleeve 2, without contact between the surfaces 13,14 and 15,16, respectively, the cover 12 being unremoved. In FIG. 2 the column 8 has been brought to such a height in the sleeve 2 that the sealing surfaces 13,15 give such a sealing that the cover 12 is no longer required, and the top end of the column 8 and the trunk 10 are accessible for establishment or release of connection to the structure inside the vessel.

Figure 3:
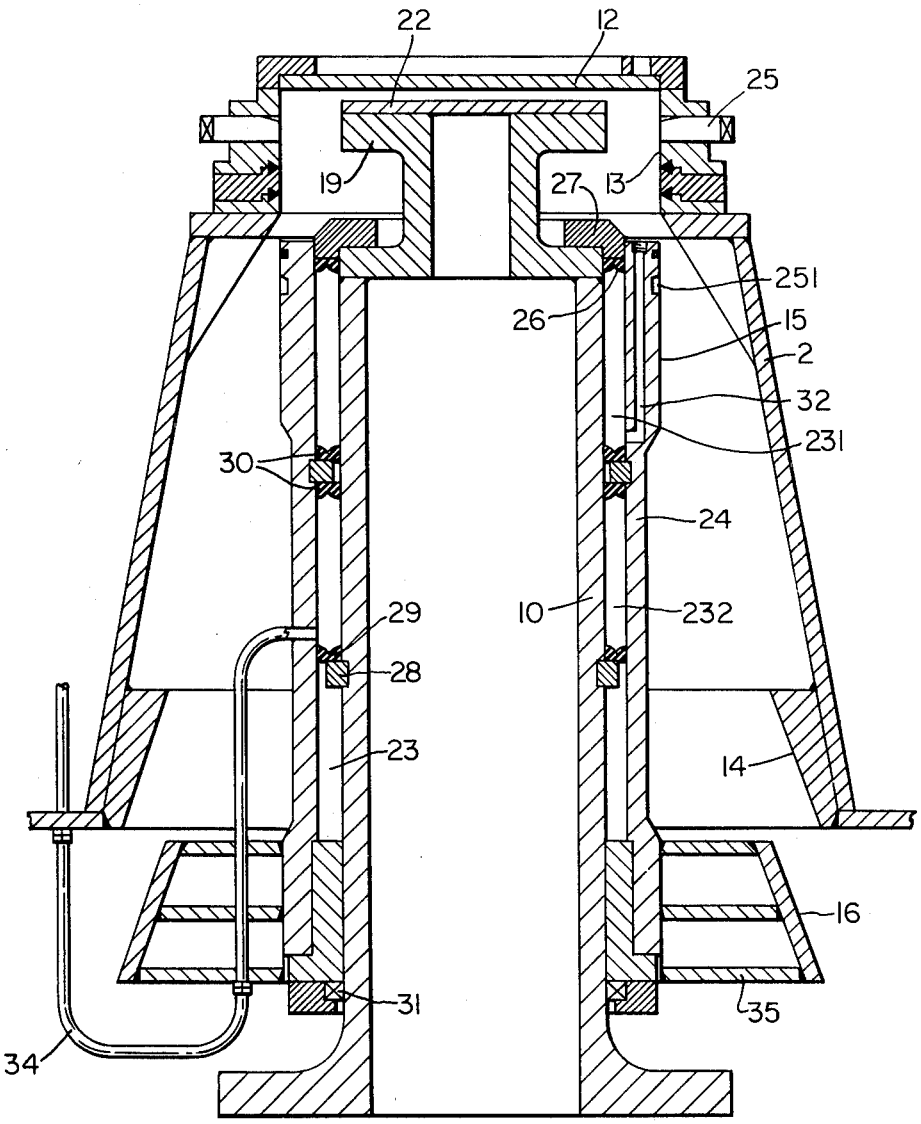
FIGS. 3 to 5 show the upper part of the column of the assembly in a enlarged scale and in different stages of a mounting or dismounting operation.
Figure 4:
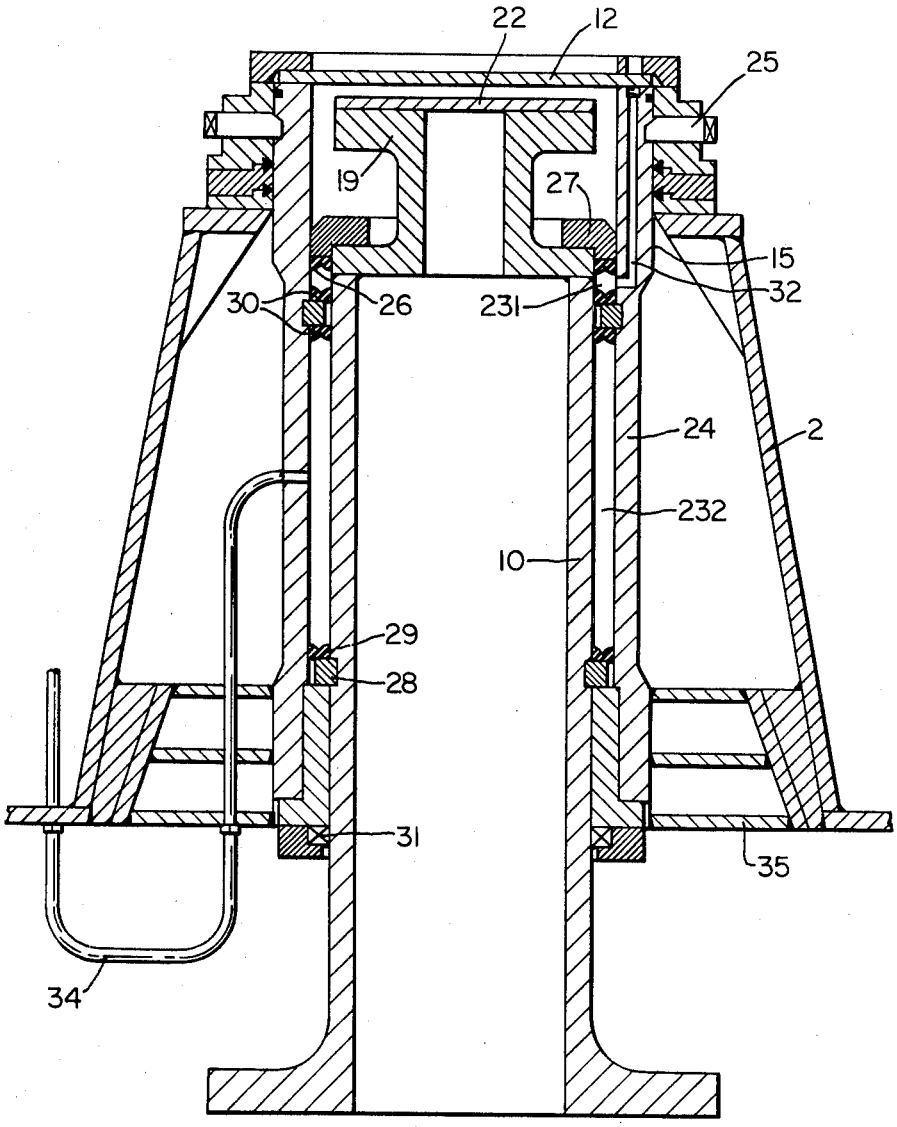
Figure 5:
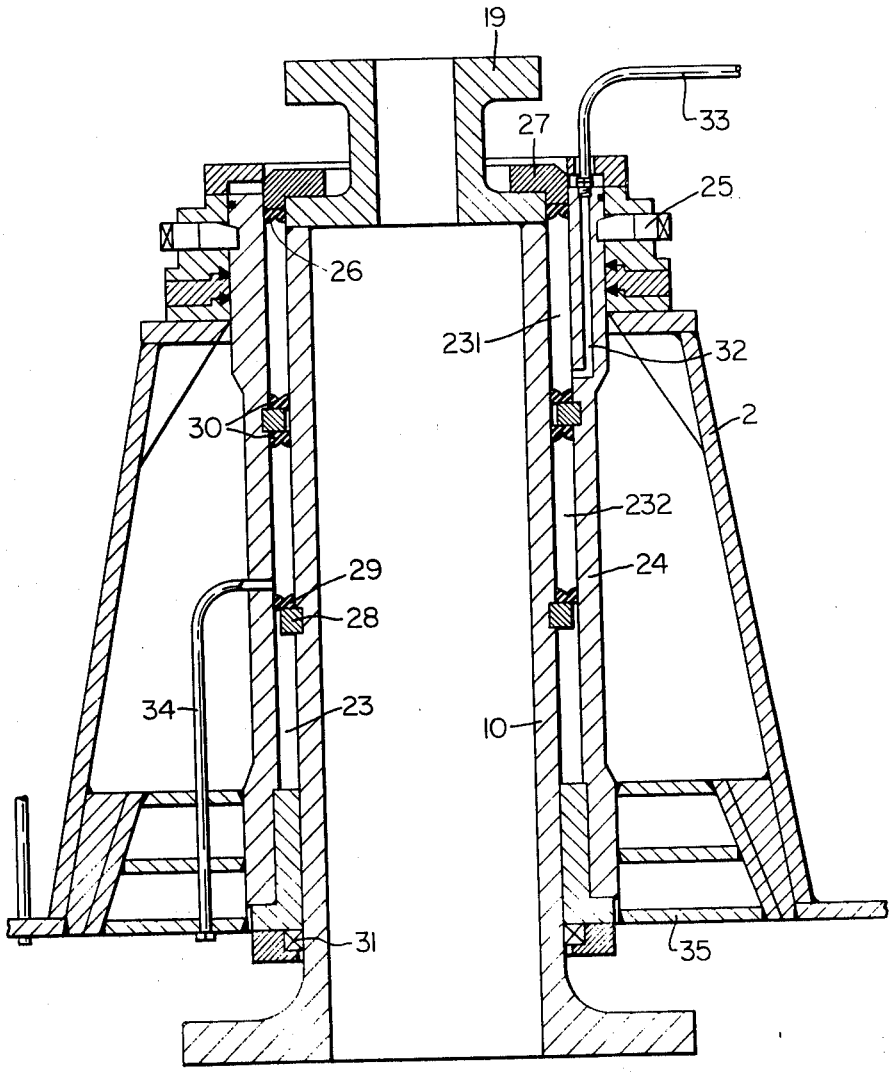

FIG. 3–5 show in a longitudinal, sectional view the top part of the column 8 and the sleeve 2 in a larger scale. FIG. 3 shows the various parts in the positions corresponding to those shown in FIG. 1, while the positions shown in FIG. 5 correspond to those shown in FIG. 2, and FIG. 4 shows the parts in the positions in which the sealing surfaces are just in sealing contact, i.e., a position intermediate the positions shown in FIGS. 1 and 2.

As shown, the trunk 10 is provided with a flange 19 which, in the position shown in FIG. 3, is covered by a plate 22 which may be removed when the sealing surfaces 13 and 15 are in sealing contact. The trunk 10 is situated within an intermediate sleeve 24, with an interspace 23 therebetween. In the embodiment shown, the intermediate sleeve 24 forms the outer part of the column 8 and comprises the sealing and centering surfaces 15,16 adapted to cooperate with the surfaces 13,14, respectively. The surfaces 13 and 15 are provided with interlocking means 25.

The trunk 10 is rotatably received in the intermediate sleeve 24 and may be moved axially in guides at both ends of the sleeve. A number of gaskets are positioned in the interspace 23 between the trunk 8 and the intermediate sleeve 24, whereby the interspace chamber is divided in two chamber portions 231,232 which may serve as servomotor chambers for axial movement of the trunk 10 relatively to the intermediate sleeve 24. The upper chamber portion 231 has a top end defined by the gasket 26 and a split ring 27 fixed to the trunk 10. Correspondingly, the lower chamber portion 232 has a lower end defined by a split ring 28 and a gasket 29. A split ring and gaskets 30 are positioned between the chamber portions in the intermediate sleeve 24. The interspace is sealed against the sea by means of a gasket 31.

When the column is in its upper position, as shown in FIG. 5, the upper chamber portion 231 is, through a passage 32, in communication with a source of pressure fluid inside the vessel via conduit 33, while the chamber portion 232 is adapted to be connected to a source of pressure fluid inside or outside the vessel through a flexible pipeline 34. The chamber portions may be connected through conduits, not shown in the drawings, to a pressure accumulator which may suitably be incorporated in the support structure 35 presenting the centering surface 16.

The following is a description of the functioning of the means.

When mounting the propeller assembly in the sleeve 2, the assembly is initially brought into the position shown in FIG. 1. Thereafter, pressure fluid is let into the chamber portion 232 through the conduit 34, whereby the intermediate sleeve 24 is moved upwardly along the trunk 10 and the surfaces 13,14 and 15,16 brought into contact with each other, as shown in FIG. 4, in which position the interlocking means 25 may be entered into corresponding recesses 251 in the surface 15 of the sleeve 24, and the covers 22 and 12 may be removed. At this stage, the passage may be connected to the conduit 33. The chamber portion 231 is now pressurized by means of fluid through the conduit 33 and the passage 32, at the same time as the pressure in the chamber 232 is released. Thereby, the trunk 10 with the propeller assembly is raised, guided in the sleeve 24, until the flange 19, passing freely through the opening which was previously closed by the cover 12, engages the flange 18 on the steering unit, as shown in FIG. 2, and all connections may be effected.

When dismounting the assembly, all steps are performed in reversed order, until the assembly is released so as to be lifted out of the water by means of appropriate equipment.

I claim:

1. A vessel propulsion and steering device which is vertically mountable in an elongated, hollow, downwardly open sleeve located in the hull of the vessel, the hollow, downwardly open sleeve including an upper inner sealing surface, a lower inner sealing surface and a removable cover on the end thereof inside said vessel, the propulsion and steering device including an elongated, hollow, cylindrical intermediate sleeve positionable within said hollow sleeve and including an upper outer sealing surface and a lower outer sealing surface, which surfaces are respectively engageable with said upper inner sealing surface and said lower inner sealing surface of said hollow, downwardly open sleeve;

an elongated propeller assembly having at one end a rotatable propeller and at the other end and elongated, hollow, cylindrical trunk which is mounted within said elongated, hollow, cylindrical intermediate sleeve so as to leave an annular space therebetween, said trunk of said propeller assembly being both axially movable and rotatable within said intermediate sleeve;

means positioned between said trunk and said intermediate sleeve for forming two variable volume chambers therebetween; and means for separately supplying pressure medium to either of said two chambers; such that when said intermediate sleeve and trunk is positioned generally within said hollow, downwardly open sleeve, pressure medium can be supplied to one of said two chambers to move said intermediate sleeve with its upper and lower outer sealing surfaces relatively to the upper and lower inner surfaces, respectively, of said hollow, downwardly open sleeve, whereas when pressure medium is supplied to the other of said chambers the trunk of said propeller assembly is moved relatively to said removable cover.

2. The propulsion and steering device of claim 1, wherein said means positioned between said trunk and said intermediate sleeve for forming two chambers therebetween comprise three axially spaced apart fluid-tight gaskets.

3. The propulsion and steering device of claim 1, wherein said hollow trunk has a removable cover on the end thereof remote from said propeller.

4. The propulsion and steering device of claim 1, wherein said means for separately supplying pressure medium to either of said two chambers comprise a first conduit in said hollow, downwardly open sleeve which is capable of transmitting pressure medium therethrough and into one of said two chambers, and a second flexible conduit which is capable of supplying pressure medium to the other of said chambers.

5. The propulsion and steering device of said claim 4, wherein said two chambers comprise an upper chamber and a lower chamber; wherein said intermediate sleeve includes a means forming a first radial aperture therein communicating with said lower chamber; wherein said flexible conduit is connected at the end to said radial aperture and at the other end to a source of pressure medium; wherein said intermediate sleeve includes a means forming a second radial aperture therein communicating with said upper chamber; and wherein said second radial aperture is in sealed communication with said first conduit in said hollow, downwardly open sleeve when said upper and lower outer sealing surfaces of said intermediate sleeve are engaged with the respective upper and lower inner sealing surfaces of said hollow, downwardly open sleeve.

6. The propulsion and steering device of claim 1, wherein said intermediate sleeve has means forming at least one annular recess in the outer surface thereof, and wherein said hollow, downwardly open sleeve includes an interlocking means on the inner surface thereof capable of interlocking within said annular recess of said intermediate sleeve when said upper and lower outer sealing surfaces of said intermediate sleeve are engaged with the respective upper and lower inner sealing surfaces of said hollow, downwardly open sleeve.

7. A vessel propulsion and steering system which comprises an elongated, hollow, downwardly open sleeve located in the hull of the vessel, said downwardly open sleeve including an upper inner sealing surface and a lower inner sealing surface, one end of said downwardly open sleeve opening to the outside of said hull and the other end covered by a removable cover;

a structure in said vessel and positioned adjacent to said other end of said downwardly open sleeve for supplying propulsion and steering power to a vessel propulsion and steering device;

a vessel propulsion and steering device positioned inside of said downwardly open sleeve comprising an elongated, hollow, cylindrical intermediate sleeve having an upper outer sealing surface and a lower outer sealing surface;

an elongated, hollow, cylindrical trunk positioned within said intermediate sleeve, said trunk being rotatable and axially movable within said intermediate sleeve and leaving an annular space therebetween; said trunk having a removable cover on the end adjacent the removable cover on said downwardly open sleeve and at the other end being connected to a propeller assembly containing a propeller attached thereto; means positioned between said trunk and said intermediate sleeve for forming two variable volume chambers therebetween; and means for separately supplying pressure medium to either of said two chambers; such that with sequential filling of said two chambers with pressure medium, said vessel propulsion and steering device can be brought into and out of a fixed, sealing position within said downwardly open sleeve and said structure in said vessel can be connected to and disconnected from, respectively, said trunk.

* * * * *